US006438763B2

(12) United States Patent
Guay et al.

(10) Patent No.: US 6,438,763 B2
(45) Date of Patent: Aug. 27, 2002

(54) PROTECTIVE HELMET

(75) Inventors: Louis Guay, Chatillon sur Chalaronne; Patricia Levrat, Saint Trivier sur Moignans; Xavier Soubeyrand, Saint Etienne, all of (FR)

(73) Assignee: Gallet S.A., Chatillon sur Chalaronne (FR)

( * ) Notice: Subject to any disclaimer, the term of this patent is extended or adjusted under 35 U.S.C. 154(b) by 0 days.

(21) Appl. No.: 09/865,525

(22) Filed: May 29, 2001

(30) Foreign Application Priority Data

May 29, 2000 (FR) ..... 00 06822

(51) Int. Cl.[7] ..... A42B 1/08
(52) U.S. Cl. ..... 2/424; 2/6.4
(58) Field of Search ..... 2/424, 6.3, 6.4, 2/6.5, 6.7, 15, 10, 9

(56) References Cited

U.S. PATENT DOCUMENTS

| | | | | | |
|---|---|---|---|---|---|
| 2,302,231 | A | * | 11/1942 | Lobelle | 2/10 |
| 3,315,272 | A | * | 4/1967 | Olt et al. | 2/424 |
| 3,543,308 | A | * | 12/1970 | Stapenhill | 2/6.4 |
| 4,100,619 | A | * | 7/1978 | Piech et al. | 2/10 |
| 4,170,792 | A | * | 10/1979 | Higgs | 2/10 |
| 5,329,642 | A | * | 7/1994 | Dampney | 2/424 |
| 5,467,480 | A | * | 11/1995 | Baudou et al. | 2/424 |
| 5,544,361 | A | * | 8/1996 | Fine et al. | 2/10 |
| 5,680,356 | A | * | 10/1997 | Gath | 2/411 |
| 5,890,233 | A | * | 4/1999 | Kaffka | 2/10 |
| 6,282,726 | B1 | * | 9/2001 | Noyerie et al. | 2/424 |

FOREIGN PATENT DOCUMENTS

| | | |
|---|---|---|
| DE | 29703799 | 5/1997 |
| FR | 2532528 | 3/1984 |
| FR | 2750299 | 1/1998 |
| FR | 2773051 | 7/1999 |
| GB | 2172791 | * 10/1986 |

* cited by examiner

*Primary Examiner*—Rodney M. Lindsey
(74) *Attorney, Agent, or Firm*—Greenblum & Bernstein, P.L.C.

(57) ABSTRACT

Protective helmet includes an outer shell adapted to protect a user's head. A connecting element is connected to the outer shell. At least a first shield is pivotally mounted to one of a journal and the outer shell. At least a second shield is pivotally mounted to the connecting element. Each of the first and second shields pivot with respect to the outer shell.

20 Claims, 5 Drawing Sheets

PROTECTIVE HELMET

BACKGROUND OF THE INVENTION

1. Field of the Invention

The present invention relates to an improvement for a protective helmet and more particularly for a helmet having at least two front protective shields that are moveable in rotation.

2. Background and Material Information

Protective helmets have long been commonly used in different fields, whether professional, as is the case for military personnel, airplane or helicopter pilots, police officers or firemen, or civil or private use, as is the case for motorcycle users, rally or race car drivers, or construction workers.

There is no lack of applications and numerous helmets are already known which have a rigid outer shell having a substantially spherical shape, equipped with an inner lining, and adapted to nest around the user's cranium while providing a facial opening for his face at the front. These helmets generally have an inner envelope of synthetic foam adapted to absorb shocks.

Certain helmets also have facial shields adapted to promote the protection of the user's face while allowing him to observe external events. Thus, helmets provided with an external visor and an internal ocular shield are found in prior art. However, these helmets have numerous disadvantages that are linked to their manufacture, use or cost.

Indeed, it is usually difficult to obtain journals of facial shields on the outer shell and the prior art devices do not satisfy entirely given their frailty, complexity and lack of comfort during use. In addition, since protective helmets are developed to adapt to different types of users, any increase in the number of sizes necessarily implies obtaining an equal number of sizes for most of the accessories and attachments, especially for different facial shields, thus increasing the development cost of these helmets.

SUMMARY OF THE INVENTION

Thus, the object of the present invention is to solve the aforementioned disadvantages by means that are simple, reliable, easy to implement and affordable. It has the objective of presenting a protective helmet having several facial shields, the journal configuration of the shields being simplified to allow easy manipulation thereof. This configuration also allows developing several different sizes of helmets while continuing to use a single shield size, for example.

According to its main feature, the protective helmet of the invention is of the type constituted by an outer shell adapted to protect the user's head and having at least two protective shields rotationally mobile with respect to the shell, and it is characterized in that a first shield is rotationally journalled on the shell, whereas a second shield is rotationally journalled on an intermediary connecting element attached to the shell.

According to an additional feature of the protective helmet, it is characterized in that the first shield is journalled about a pivot axis that is integral with the shell, and the second shield is journalled about a pivot axis that is integral with the connecting element, and in that these two pivot axes are co-axial and are borne by the same transverse axis.

According to the preferred embodiment of the protective helmet of the invention, the main transverse axis bearing the journal axes is arranged in a zone located substantially at the upper end of the user's ear.

According to an alternative embodiment of the protective helmet of the invention, the rotational axes of the protective shields are not arranged in a co-axial manner.

According to another feature of the protective helmet, it is characterized in that the first shield journalled on the shell is a large sized facial shield adapted to at least partially occupy, when it is in a position of use, a facial opening presented by the helmet, and in that the second shield journalled on the connecting element is an ocular shield adapted to be positioned into a position of use in front of the user's eyes.

According to an additional feature of the protective helmet of the invention, the connecting element is constituted of two lateral walls connected together by a portion of a spherical cap and is attached to the helmet shell so as to be immoveable with respect thereto.

According to another feature of the protective helmet, the latter is characterized in that the first shield is a facial shield assembled onto a shield support which extends it and which is journalled on the shell about a pivot axis.

According to the preferred embodiment of the protective helmet of the invention, the shield support has two lateral walls, both of them having an attaching member for the facial shield and a pivot opening adapted to cooperate with the journal axis attached to the shell.

According to an additional feature of the protective helmet of the invention, the shield support has a pivot opening adapted to cooperate with a journal axis attached to the shell, and in that the opening and the axis have complementary indexing means adapted to index at least the two extreme positions of the facial shield.

According to another feature of the protective helmet, the latter is characterized in that it has a rigid shock absorbing cap that is maintained in position in the upper portion of the shell, due at least partially to the connecting element.

BRIEF DESCRIPTION OF DRAWINGS

Other features and advantages of the invention will become apparent from the description that follows with reference to the attached drawings which are given only by way of non-limiting examples.

FIGS. 1–9*b* show the preferred embodiment of the helmet of the invention.

FIG. 1 shows a perspective view of the helmet and its outer facial shield in the lowered protective position.

FIG. 2 shows a perspective view of the helmet with its outer facial shield in a raised position and its ocular shield in a lowered position.

FIG. 3 shows a perspective view of the helmet with its outer facial shield in a raised position and its ocular shield in a raised position.

FIG. 4 shows an exploded perspective view of the assembly of the outer facial shield.

FIG. 5 shows an exploded perspective view of the ocular shield and its assembly to the connecting piece.

FIG. 6 shows a longitudinal cross-sectional view of the helmet and its facial shields in a raised position.

FIG. 8 shows a perspective view of a helmet without its protective facial shields.

FIG. 9*b* shows a lateral view of the ocular shield. .

DETAILED DESCRIPTION OF THE PREFERRED EMBODIMENTS

Figure 1:
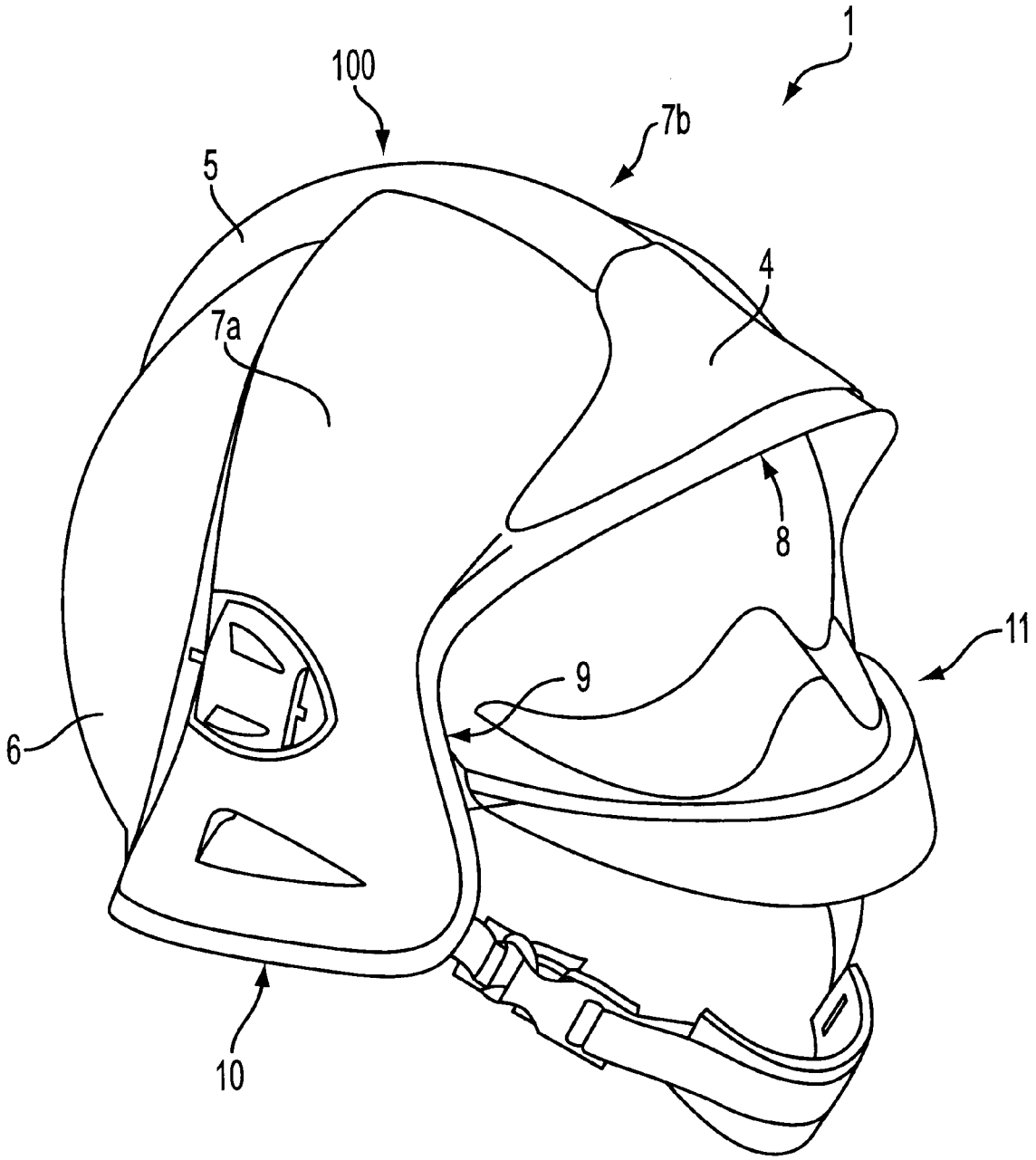

The helmet (1) equipped with protective shields according to the invention can be of any type, such as, for example, of the type used by firemen, military personnel or motorcyclists, or even bicyclists or skiers. It has a main outer shell (100) that protects the user's cranium and nape, and it has a front facial opening (2) in the zone occupied by the user's face. The helmet has a generally symmetrical longitudinal vertical plane (P).

The shell (100) is of a rigid material and can be made of any appropriate material, such as plastic, steel, aluminum, or of a composite material of the type including a layering of reinforcement fibers that are impregnated and connected together by a resin matrix. According to the overall structure of the helmet (1), the outer shell (100), is constituted by a substantially spherical wall having several wall portions, namely, an upper front wall portion (4) extended rearwardly by an upper rear wall portion (5) which is itself extended downwardly by a lower rear wall portion (6) and, in addition, it has two lateral wall portions: a right lateral wall portion (7*a*) and a left lateral wall portion (7*b*). The upper front portion (4) corresponds to the zone occupied by the user's forehead and is limited by the upper edge (8) of the facial opening (2) which in turn is limited laterally by two lateral edges (9). The upper rear wall portion (5) corresponds to the zone occupied by the user's cranium, whereas the lower rear wall portion (6) corresponds to the zone occupied by the user's nape. Added to this is the fact that the wall of the shell (100) is limited toward the bottom by a lower edge (10). The lateral wall portions (7*a*, 7*b*) correspond to the zones occupied by the user's ears and are limited towards the front by the corresponding lateral edge (9) of the facial opening (2), and toward the bottom by the front ends of the lower edge (10).

According to the invention, the helmet (1) has at least two protective shields (11, 12), both shields being rotationally mobile with respect to the shell (100) between two positions, namely, between an active lowered position of use (B1, B2), and an inactive raised position of non-use (A1, A2).

According to the invention, the first shield (11) is journalled directly on the shell (100), whereas the second shield (12) is journalled on a connecting element (15) integral with the shell (100).

Figure 2:
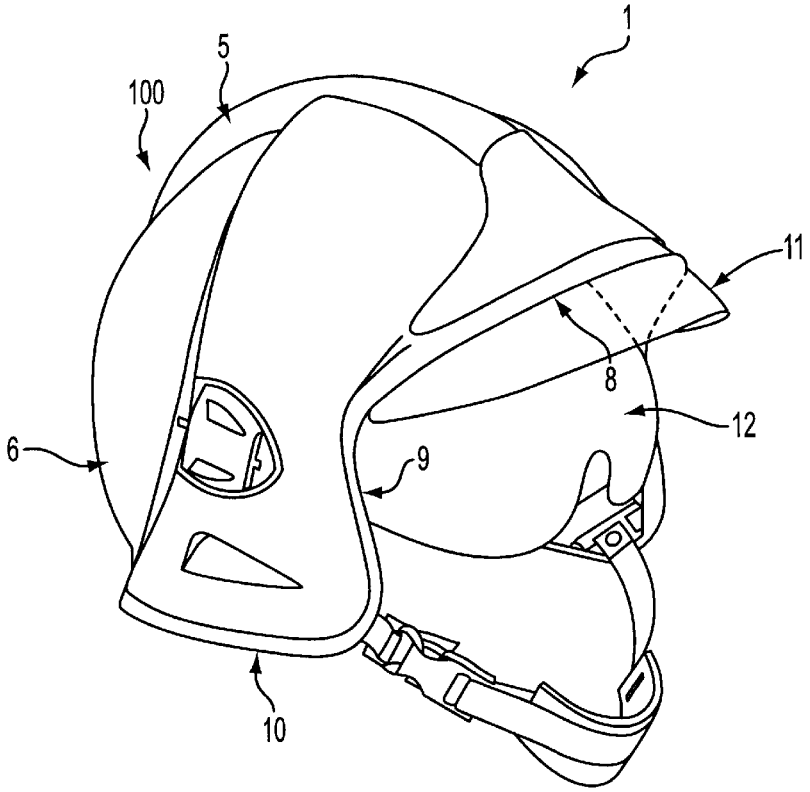
Figure 3:
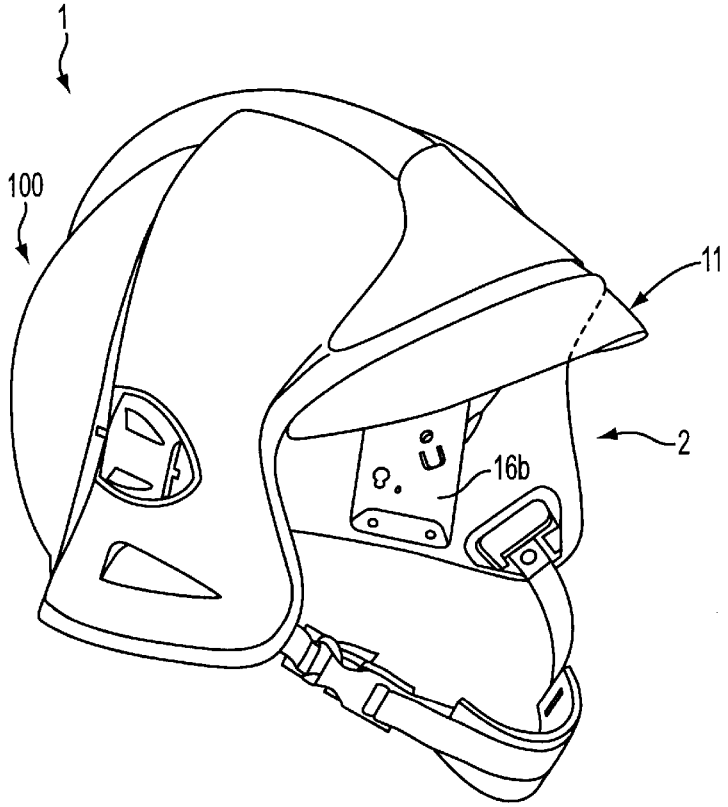

According to the preferred embodiment of the helmet (1) of the invention, the helmet has a large sized facial shield (11) adapted to occupy the facial opening (2) when it is in a position of use (B1), as shown in FIG. 1. It also includes a smaller sized shield, called an ocular shield (12), adapted to be positioned more specifically in front of the user's eyes when it is in a position of use (B2), as shown in FIG. 2.

Figure 9A:
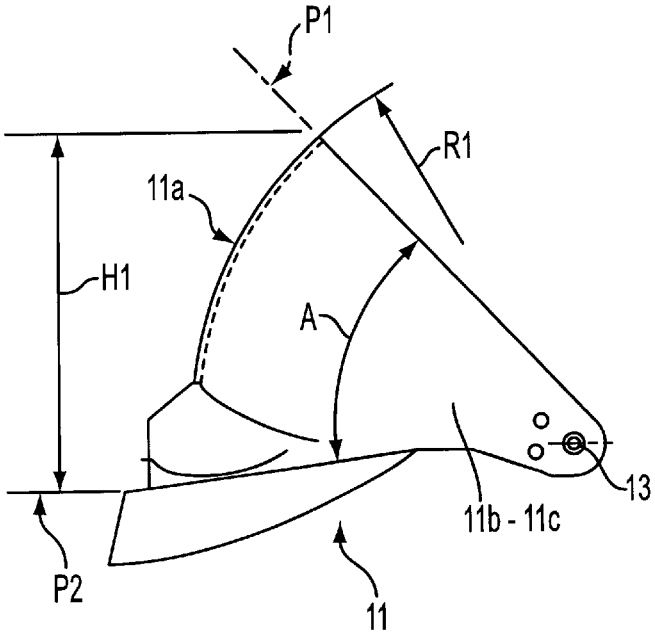
FIG. 9*a* shows a lateral view of the outer facial shield
Figure 9B:
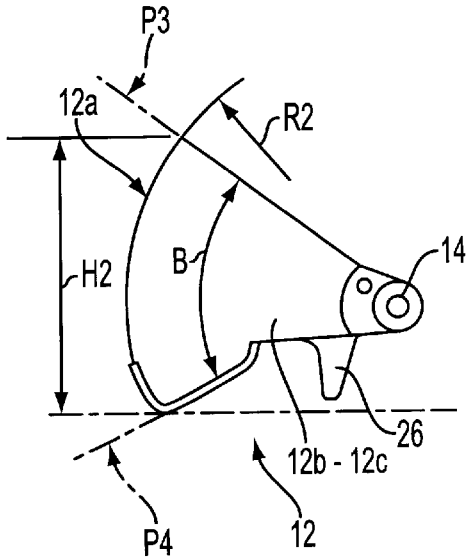

The first shield (11) shown in FIG. 9*a* is constituted by a transparent wall made, for example, from plastic of the polycarbonate type or the like. This wall is essentially a spherical portion that is limited in order to be comprised between the two converging transverse planes (P1, P2) forming a dihedral with an angle A open towards the front. The facial shield is constituted by a front wall (11*a*) formed by a substantially spherical portion having a radius (R1) extended laterally towards the rear by two lateral arms (11*b*, 11*c*). The second shield (12) or ocular shield shown in FIG. 9*b* is constituted by a transparent wall made, for example, from plastic of the polycarbonate type or the like. This wall is essentially a spherical portion that is limited in order to be comprised between the two converging transverse planes (P3, P4) forming a dihedral with an angle B open towards the front. The ocular shield (12) is constituted by a front wall (12*a*) formed by a substantially spherical portion with a radius (R2) extended laterally towards the rear by two lateral arms (12*b*, 12*c*). Added to this is the fact that the angle A formed by the two planes (P1, P2) is greater than the angle B formed by the two planes (P3, P4), and that the radius (R1) of the spherical wall of the first shield (11) is greater than the radius (R2) of the spherical wall of the second shield (12).

As mentioned, the second shield (12) or ocular shield is of a smaller size than the first shield (11) or facial shield. Thus, the front wall (11*a*) of the first shield (11) has a height (H1) measured in the generally symmetrical plane (P), which is greater than the height (H2) of the front wall (12*a*) of the second shield (12) measured under the same conditions.

The first shield (11) or facial shield is journalled directly about a rotational axis (13) integral with the shell (100), whereas the ocular shield (12) is journalled about a rotational axis (14) integral with an intermediary connecting element (15) attached to the shell (100) of the helmet (1).

According to the preferred embodiment of the helmet (1) of the invention, the journal axes (13, 14) of the two shields are advantageously arranged in each other's extension, i.e., they are borne by the same generally pivoting transverse axis (XX') that is substantially orthogonal to the lateral walls (7*a*, 7*b*) of the helmet. It goes without saying that the two axes could be positioned in two separate locations so as to no longer be co-axial without leaving the scope of protection of the invention.

Figure 5:
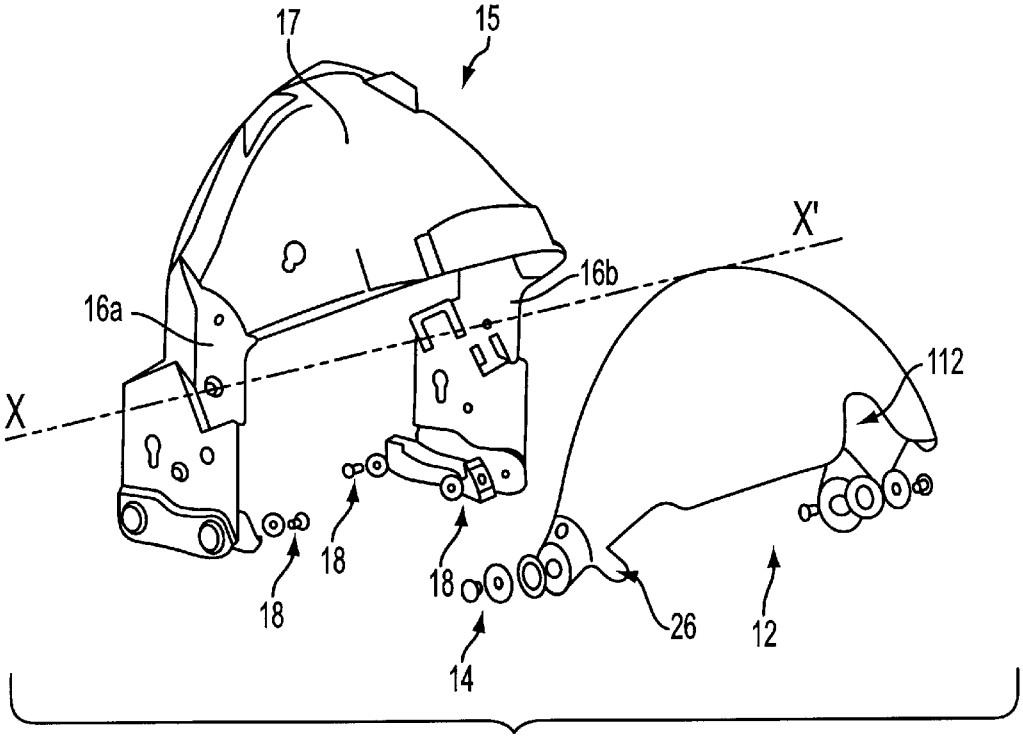
Figure 6:
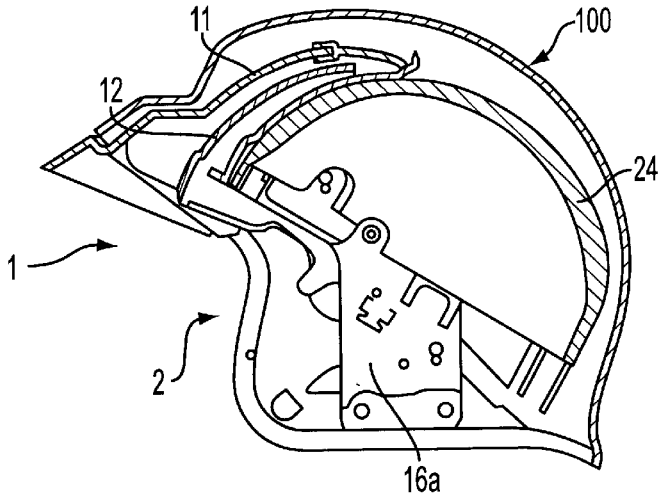
Figure 7A:
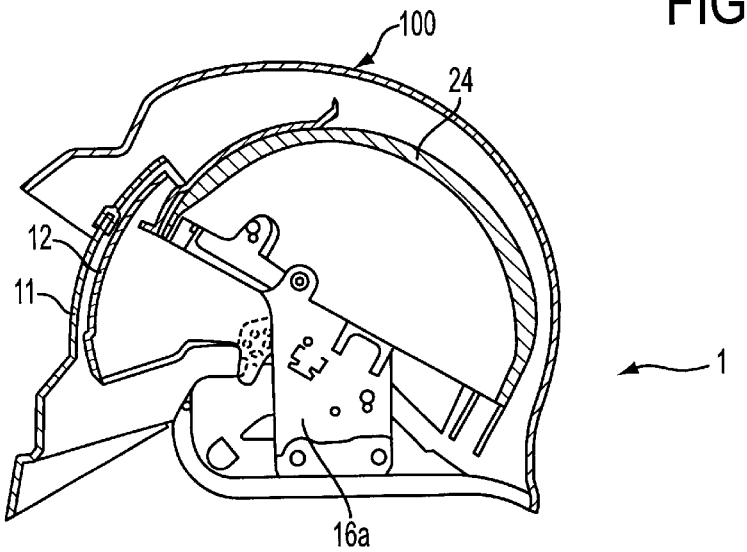
FIGS. 7*a* and 7*b* show, in views similar to FIG. 6, the helmet with its outer facial shield in a lowered position and the ocular shield in a raised and lowered position, respectively.
Figure 7B:
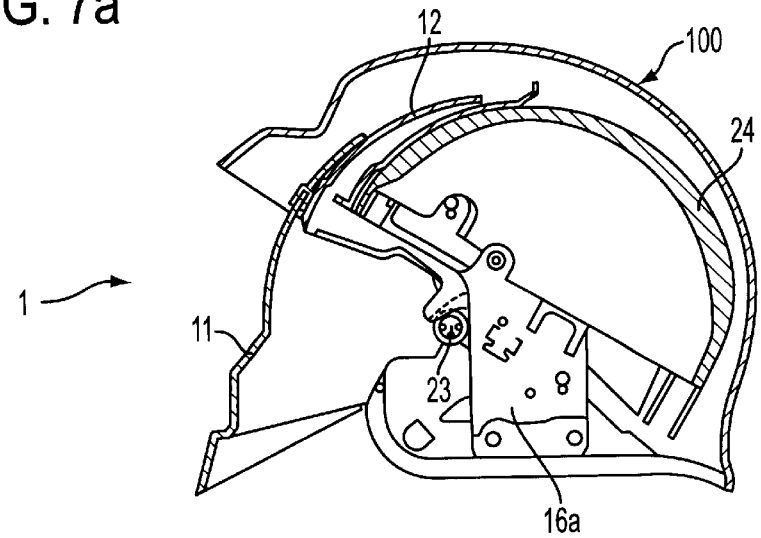
Figure 8:
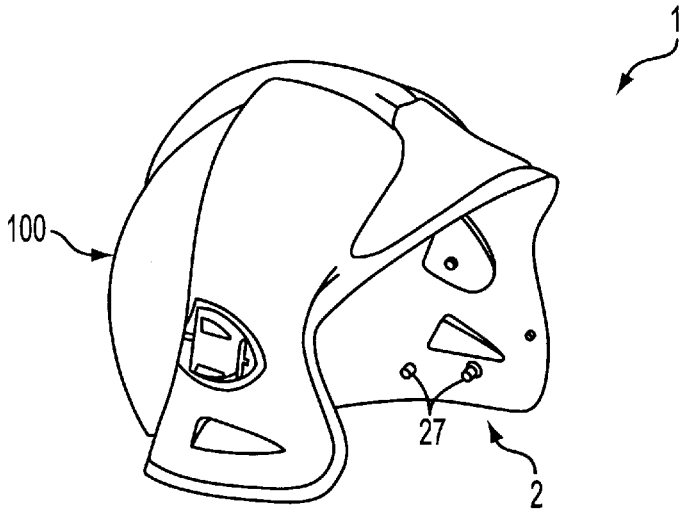

The intermediary element (15) is formed of two lateral walls (16*a*, 16*b*) connected together by a portion of a spherical cap (17). It is advantageously attached to the shell (100) at the lower end of its lateral walls so as to be immoveable with respect to the shell. The attachment of the connecting piece (15) is done at two separate points of each of the lateral walls (16*a*, 16*b*) near the lower edge (10) of the shell (100) by means of two screws (18) adapted to cooperate with complementary housings (27) located on the inner surface of the shell, as shown in FIGS. 5 and 8.

Figure 4:
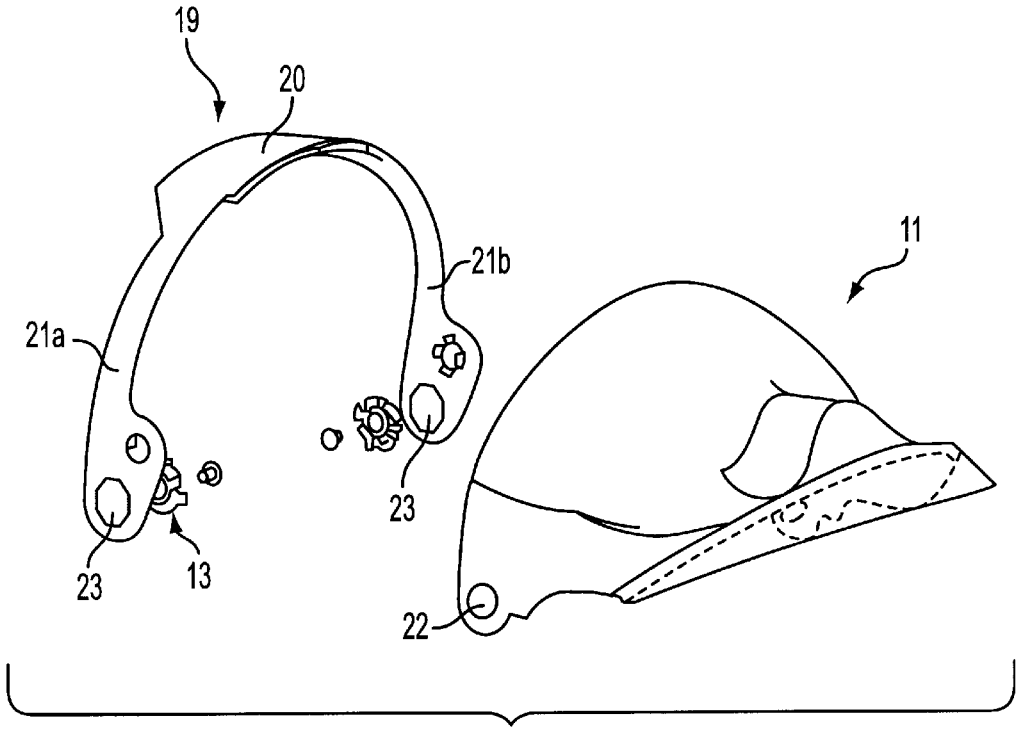

According to the preferred embodiment of the helmet (1) of the invention, the journal of the ocular shield (12) and of the facial shield (11) is obtained co-axially in a zone located substantially at the level of the upper end of the user's ear. It is noted that in order to use the same type of facial shield (11) for the different shell sizes (100) of the helmet (1), the facial shield (11) itself is affixedly assembled to a shield support (19) which allows extending the facial shield and which is journalled on the pivot axis (13) arranged on the inner surface of the shell. Thus, to develop several helmet sizes, a facial shield of one size is used and is adapted to be installed on any helmet by means of a shield support (19) which allows adapting the shield to all sizes of shells (100) by lengthening the journal arms. This support element (19) is in the shape of an arc (20) that extends between two lateral wall portions (21*a*, 21*b*), which each have an attaching member for the facial shield, such as affixing tabs arranged in a circular manner and projecting in toward the helmet to cooperate with an opening (22) located at the end of the facial shield itself, as shown in FIG. 4. These wall portions (21*a*, 21*b*) of the support (19) also have, at their lower end, a journal opening (23) adapted to cooperate with the journal axis (13). As shown in FIG. 4, it is noted that the shape of the opening (23) is not round but polygonal, thus allowing it to cooperate with complementary indexing means described hereinafter, which allow indexing the specific positions of the facial shield (11), such as the active position (B1) and the raised position (A1).

According to the preferred embodiment of the helmet, the indexing means and the journal axis are obtained from the same element (13) that is attached to the shell (100) by means of a known screw system (18) and housing for attachments (27). This journal and indexing element (13) includes an assembly of ramps and projections adapted to index at least two extreme positions (A1, B1) due, in particular, to the elastic deformation of the lateral walls (21*a,* 21*b*) that are distanced one from the other when their opening (23) and the ramps cooperate to allow pivoting between the two extreme indexed positions (A1, B1).

According to the preferred embodiment of the helmet (1), the latter has a rigid shock absorbing cap (24) made of polyurethane foam, for example, and adapted to occupy the upper portion of the shell (100). This cap (24) is advantageously maintained in position in the shell (100) due to the intermediary connecting element (15).

According to an embodiment of the helmet that is not shown, the journal axes of the two shields are no longer co-axial but occupy a separate position, the journal axis of the facial shield being arranged on the shell and that of the ocular shield being arranged on the intermediary connecting element in different positions. The facial shield is mounted on its support and thus allows extending the shield up to its journal axis, whereas the ocular shield is journalled about a journal axis of a traditional type which has no specific indexing means, but whose shield position can be blocked due to the friction between the axis and the shield while pivoting. It is noted that the ocular shield can also be provided with indexing means that are similar or dissimilar to those of the outer facial shield.

It is also noted that the ocular shield (12) has a maneuvering handle (26) arranged on the lower edge of the ocular shield near the journal axis (14) which bears it and the facial opening (2) so as to allow the user to activate it.

In order to correctly define the pivoting positions and to protect the indexing means which can be arranged on the two shields (12, 13), it is noted that an abutment system which limits the pivoting of one or both shields downwardly and/or upwardly could also be provided. Added to this is the fact that the pivoting of one or both shields could be free or stopped, such as, for example, by friction at the level of its journal (13 and/or 14) or elsewhere in an appropriate zone.

From the drawings, it is noted that the ocular shield and more specifically its front wall (12*a*) has, during pivoting, a very short trajectory such that this shield is very close to the user's face, and especially to the eyes, just like ordinary glasses.

In fact, a central cutout (112), open downwardly, is advantageously provided, and is adapted for the passage of the user's nose. Furthermore, a comfort and finishing joint can be provided on the lower edge of the shield. The facial shield (11) has, during its pivoting, a trajectory that is naturally farther apart which allows the shield to move forwardly beyond the zone occupied by the user's nose.

It is understood that the user could individually place either of the two in a lowered or raised position, or both shields at the same time, as shown in FIGS. 1–3, and 6–7*b,* in particular.

It is noted that the helmet advantageously has an inner cap (not shown) adapted for the user's comfort and correct positioning of the helmet. In the rear part of the helmet, this cap is advantageously attached directly to the attaching members arranged on the inner surface of the shell, whereas in the front part of the helmet, it is attached to the intermediary connecting element which bears the ocular shield and its journal.

Of course, the invention is not limited to the embodiments described and represented by way of examples, and it also includes any technical equivalents as well as combinations thereof.

The instant application is based upon the French priority Patent Application No. 00 06822, filed May 29, 2000, the disclosure of which is hereby expressly incorporated by reference thereto, and the priority of which is hereby claimed under 35 U.S.C. §119.

What is claimed is:

1. A protective helmet comprising:

an outer shell adapted to protect a user's head;

a connecting element connected to the outer shell;

at least a first shield pivotally mounted to a journal, the first shield being pivotally mounted within the outer shell; and at least a second shield pivotally mounted to the connecting element, wherein each of the first and second shields can pivot with respect to the outer shell.

2. The protective helmet of claim 1, wherein the journal to which the first shield is mounted comprises a first pivot axis and is integrally formed with the outer shell.

3. The protective helmet of claim 2, wherein the second shield is connected to the connecting element via a journal, whereby the journal connecting the second shield to the connecting element comprises a second pivot axis and is integrally formed with the connecting element.

4. The protective helmet of claim 3, wherein the first and second pivot axes are coaxially arranged.

5. The protective helmet of claim 3, wherein each of the first shield and the second shield pivot about a common pivot axis.

6. The protective helmet of claim 5, wherein the common pivot axis is arranged in a zone adapted to be located substantially at an upper end of a user's ear.

7. The protective helmet of claim 1, wherein the first shield pivots about a first axis and the second shield pivots about a second axis, the first axis being different from the second axis.

8. The protective helmet of claim 1, wherein the first shield comprises a facial shield which is adapted to at least partially occupy, when in a position of use, a facial opening of the helmet.

9. The protective helmet of claim 8, wherein the second shield comprises an ocular shield which is adapted to be in front of the user's eyes, when in a position of use.

10. The protective helmet of claim 1, wherein the connecting element comprises two lateral walls which are connected together by a spherical cap portion, the connecting element being attached to the outer shell so as to be immoveable with respect to the outer shell.

11. The protective helmet of claim 1, further comprising a shield support which is pivotally mounted to the outer shell, wherein the first shield is assembled to the shield support and pivots with the shield support.

12. The protective helmet of claim 1, wherein the shield support comprises two lateral walls, each of which is adapted to be connected to the first shield and each of which comprises a pivot opening which is adapted to receive a journal arranged on the outer shell.

13. The protective helmet of claim 12, further comprising an indexing mechanism adapted to index the first shield in at least the two extreme positions.

14. The protective helmet of claim 1, further comprising a rigid shock absorbing cap arranged within the outer shell.

15. The protective helmet of claim 14, wherein the shock absorbing cap is maintained in position in an upper portion of the outer shell, at least partially because of the connecting element.

16. A protective helmet comprising:

an outer shell adapted to protect a user's head;

a connecting element arranged within the outer shell and being non-movably connected to the outer shell;

a first shield movably connected to the outer shell; and a second shield movably connected to the connecting element, the second shield being arranged to pivot between the connecting element and the first shield, wherein each of the first and second shields pivot between at least an extended position and a retracted position.

17. The protective helmet of claim 16, wherein the first shield is mounted to a journal forming a first axis, the journal being integrally formed on the outer shell.

18. The protective helmet of claim 17, wherein the second shield is connected to the connecting element via a journal, whereby the journal connecting the second shield to the connecting element comprises a second pivot axis and is integrally formed with the connecting element.

19. The protective helmet of claim 18, wherein each of the first shield and the second shield pivot about a common pivot axis.

20. A protective helmet comprising:

an outer shell adapted to protect a user's head;

a connecting element arranged within the outer shell and being non-movably connected to the outer shell;

a shock absorbing cap arranged within the outer shell and retained in position by the connecting element;

a face shield movably connected to the outer shell; and an eye shield movably connected to the connecting element, the eye shield being arranged to pivot between the connecting element and the face shield, wherein each of the face and eye shields pivot between at least an extended position and a retracted position.

* * * * *